US005302484A

United States Patent [19]

Odell et al.

[11] Patent Number: 5,302,484

[45] Date of Patent: Apr. 12, 1994

[54] IMAGING MEMBERS AND PROCESSES FOR THE PREPARATION THEREOF

[75] Inventors: Peter G. Odell, Mississauga; Trevor I. Martin, Burlington, both of Canada

[73] Assignee: Xerox Corporation, Stamford, Conn.

[21] Appl. No.: 933,843

[22] Filed: Aug. 24, 1992

[51] Int. Cl.[5] ..... G03G 5/00

[52] U.S. Cl. ..... 430/127; 430/130; 430/70; 430/96; 528/371

[58] Field of Search ..... 430/127, 130, 70, 96; 528/370, 371

[56] References Cited

U.S. PATENT DOCUMENTS

| | | | |
|---|---|---|---|
| 4,265,990 | 5/1991 | Stolka et al. | 430/59 |
| 4,415,639 | 11/1983 | Horgan | 430/57 |
| 4,551,404 | 11/1985 | Hiro et al. | 430/59 |
| 4,555,463 | 11/1985 | Hor et al. | 430/59 |
| 4,587,189 | 5/1986 | Hor et al. | 430/59 |
| 4,605,731 | 8/1986 | Evans et al. | 528/371 |
| 4,644,053 | 2/1987 | Brunelle et al. | 528/371 |
| 4,888,441 | 12/1989 | Calbo, Jr. et al. | 560/198 |

*Primary Examiner*—Steve Rosasco
*Attorney, Agent, or Firm*—E. O. Palazzo

[57] ABSTRACT

A process for the preparation of supporting substrates which comprises heating a mixture of cyclic oligomers with degrees of polymerization of from about 2 to about 20 and a catalyst.

16 Claims, No Drawings

IMAGING MEMBERS AND PROCESSES FOR THE PREPARATION THEREOF

BACKGROUND OF THE INVENTION

This invention is generally directed to imaging members and processes for the preparation thereof. More specifically, the present invention relates to layered photoconductive imaging members with excellent mechanical characteristics, and wherein undesirable curling of the the supporting substrates are avoided or minimized when, for example, the member is formed as a flexible belt. In addition to belts, strong light weight drums may also be formed. In embodiments, the present invention is directed to the preparation of supporting substrates for layered imaging members, which processes comprise the polymerization of macrocyclic oligomers to provide polycarbonate substrates where curling is minimized without the need for an anticurling layer as presently needed in many situations for layered imaging members. Curling of the substrate can result in adversely effecting the life of the imaging member, and can cause images of poor resolution. Curling is primarily caused by the mismatch of thermal expansion coefficients between the polyester substrates, such as MYLAR®, with the resin polycarbonate binder of the charge transport layer. This can be substantially overcome by coating an anticurl-back-coating layer of polycarbonate onto the side of the polyester layer opposite the charge transport layer. The present invention avoids the need for the second coating by producing a substrate of polycarbonate which will possess a similar thermal expansion characteristic to the polycarbonate of the charge transport layer. By avoiding the need for the anticurl coating, there is avoided the need for an additional manufacturing step, and substantially no emissions of volatile organic compounds associated with the coating step. In addition, intrinsic internal stresses can also be created in the transport layer as a result of its inability to relax completely on drying when coated onto a polyester film. These stresses will influence the life of the photoreceptor and its failure modes, and this can be minimized when the supporting substrate is also a polycarbonate. These and other disadvantages can be avoided or minimized with the processes of the present invention. Also, in embodiments the present invention is directed to the fabrication of supporting substrates by the in situ polymerization of macrocyclic oligomers. The aforementioned photoresponsive imaging members can be negatively charged when the photogenerating layer is situated between the charge transport layer and the substrate, or positively charged when the charge transport layer is situated between the photogenerating layer and the supporting substrate. The layered photoconductive imaging members can be selected for a number of different known imaging and printing processes including, for example, electrophotographic imaging processes, especially xerographic imaging and printing processes wherein negatively charged or positively charged images are rendered visible with toner compositions of the appropriate charge. Generally, the imaging members are sensitive in the wavelength regions of from about 400 to about 850 nanometers, thus diode lasers can be selected as the light sources in some instances.

Layered imaging members with supporting substrates, such as aluminum, and polymeric materials, photogenerating and charge transport layers, including charge transport layers comprised of aryl diamines dispersed in polycarbonates, like MAKROLON®, are known, reference for example U.S. Pat. No. 4,265,900, the disclosure of which is totally incorporated herein by reference. More specifically, in U.S. Pat. No. 4,265,900 there is illustrated an imaging member comprised of a supporting substrate, like aluminum or MYLAR®, which have a tendency to curl, a photogenerating layer, and an aryl amine hole transport layer comprised of amine molecules dispersed in a polycarbonate. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Similar photoresponsive imaging members with squaraine photogenerating pigments are also known, reference U.S. Pat. No. 4,415,639. In this patent there is illustrated a photoresponsive imaging member with a substrate, a hole blocking layer, an optional adhesive interface layer, an organic photogenerating layer, a photoconductive composition capable of enhancing or reducing the intrinsic properties of the photogenerating layer, and a hole transport layer. As photoconductive compositions for the aforementioned member, there can be selected various squaraine pigments, including hydroxy squaraine compositions. Moreover, there is disclosed in U.S. Pat. No. 3,824,099 certain photosensitive hydroxy squaraine compositions.

The use of selected perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances and wherein the supporting substrate can be a metal like aluminum, or certain polymeric materials. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with a perylene pigment photogenerating component. Both of the aforementioned patents disclose an aryl amine component as a hole transport layer.

In copending application U.S. Ser. No. 537,714, the disclosure of which is totally incorporated herein by reference, there are illustrated photoresponsive imaging members with photogenerating titanyl phthalocyanine layers prepared by vacuum deposition. It is indicated in this copending application that the imaging members comprised of the vacuum deposited titanyl phthalocyanines on supporting substrates such as certain polymeric materials and aryl amine hole transporting compounds exhibit superior xerographic performance as low dark decay characteristics result and higher photosensitivity is generated, particularly in comparison to several prior art imaging members prepared by solution coating or spray coating, reference for example U.S. Pat. No. 4,429,029 mentioned hereinbefore.

In copending patent application U.S. Ser. No. 905,697 the disclosure of which is totally incorporated herein by reference, there is illustrated a process for the preparation of photoconductive imaging members which comprises coating a supporting substrate with a photogenerator layer comprised of photogenerating pigments, and subsequently applying to the photogenerating layer a mixture comprised of charge transport molecules and cyclic oligomers, and wherein said mixture is heated to obtain a polycarbonate resin binder from said cyclic oligomers.

The disclosures of all of the aforementioned publications, laid open applications, copending applications and patents are totally incorporated herein by reference.

SUMMARY OF THE INVENTION

It is an object of the present invention to provide imaging members and processes thereof with many of the advantages illustrated herein.

It is yet another object of the present invention to provide processes for the preparation of supporting substrates that can be selected for imaging members and wherein the substrate has no or minimum curl for a number of imaging cycles.

Another object of the present invention resides in the provision of supporting substrates obtained from low viscosity melts, for example from about 10 to about 750 poise of macrocyclic carbonate oligomers.

Further, another object of the present invention resides in a process for the polymerization of low viscosity melts of macrocyclic carbonate oligomers.

Another object of the present invention resides in the provision of supporting substrates that require no anticurl layer when selected for layered imaging members selected for xerographic imaging and printing processes.

Also, in another object of the present invention there are provided thin film polycarbonate substrates.

Further, in another object of the present invention there are provided supporting substrates with fillers therein, such as silicas or glass fiber, to enable, for example, abrasion resistance, and increase the strength thereof.

Another object of the present invention resides in the provision of supporting substrates with conductive fillers therein, such as carbon black, to enable, for example, certain conductivity properties; the inclusion of foaming agents therein for material reduction; and wherein in embodiments seamless substrates can be obtained.

In embodiments, the present invention is directed to the preparation of supporting substrates which comprises the polymerization of macrocyclic oligomers. More specifically, the process comprises the preparation of imaging members comprising the simultaneous formation of a conductive substrate comprised of a polycarbonate resin binder, and wherein the resin binder is formed from a cyclic oligomer mixture and a conductive filler such as acetylene carbon black.

The synthesis of BP(A) cyclic oligomers is illustrated in Brunelle et al. *Jour. Amer. Chem.* Soc., 1990. 112, 2399–2402, the disclosure of which is totally incorporated herein by reference. The reaction can be conducted in a one liter Morton flask equipped with a mechanical stirrer, a condenser, septum, addition funnel and heating mantle. To this flask were added 200 milliliters of methylene chloride, 7 milliliters of deionized water, 3 milliliters of 9.75 Molar NaOH solution, and 2.4 milliliters of triethyl amine. Stirring and gentle reflux were begun. Bisphenol A bischloroformate from VanDeMark Chemical Co. of Lockport, N.Y., previously recrystallized from hexane, and about 70.5 grams were dissolved into 200 milliliters of methylene chloride and added to a flask by means of a peristaltic pump over the course of 40 minutes. Concurrently, about 59 milliliters of about 9.75 Molar sodium hydroxide solution was added by means of the addition funnel and about 2.4 milliliters of triethyl amine added by means of a syringe pump. After 40 minutes, the reaction was terminated by the addition of 200 milliliters of 1M HCl solution. The reaction mixture was transferred to a separatory funnel where the organic and aqueous layers separated and the organic layer was washed with deionized water (3 times) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 grams of a mixture of different ring sizes of cyclic oligomers of 4,4'-isopropylidenebisphenol carbonate. As Brunelle teaches in *Macromolecules*, 1991, 24, 3035, the mixture of different ring sizes, as opposed to a single discrete size, is important to achieve a lower melting and hence processable material, the same paper extensively characterized the oligomers mixture and we believe we are producing a very similar mixture. Confirmation of the product structure was determined by GPC and NMR.

About 0.85 gram of the cyclic oligomers obtained above and 0.15 gram of acetylene carbon black were ground and mixed for about three minutes with an agate mortar and pestle. About 0.0050 gram of tetrabutylammonia tetraphenylborate was added to the mixture in the mortar and a further three minutes of grinding and mixing carried out. The resulting fine powder mixture was spread thinly between two TEFLON® disc upon which 2 killigrams weight was placed and then heated in an inert atmosphere for about 60 to 80 minutes.

The sample was placed on a hotplate and heated at 300° C. A tough continuous film resulted with a resistance of about 1,000 ohms. A portion of the film was dissolved in THF, filtered and its molecular weight measured by GPC. The GPC results indicate that about 80 percent of the cyclic oligomers had been converted to high polymer and the molecular weight of this polymer was found to be $M_w$ of 105,000 and $M_n$ of 57,600 relative to polystyrene standards.

Examples of photogenerating pigments include metal free phthalocyanines, such as x-form phthalocyanine, metal phthalocyanines, such as phthalocyanine, vanadyl phthalocyanines, titanyl phthalocyanines, especially Type IV titanyl phthalocyanine, squaraines, bisazos, trigonal selenium, amorphous selenium, selenium alloys, such as selenium tellurium, selenium tellurium arsenic, and other known photogenerating pigments. These pigments are present in various effective amounts, such as for example from about 5 to about 95 weight percent, in a polymer resin binder. Also, the photogenerating pigments in embodiments can be present in an amount of 100 percent, thus no polymeric binder is present. The thickness of this layer can vary, for example, from about 0.1 to about 10 microns in embodiments.

The photoresponsive imaging members of the present invention can be prepared by a number of known methods, the process parameters and the order of coating of the layers being dependent on the member desired. The imaging members suitable for positive charging can be prepared by reversing the order of deposition of photogenerator and hole transport layers. The photogenerating and charge transport layers of the imaging members can be coated as solutions or dispersions onto selective substrates by the use of a spray coater, dip coater, extrusion coater, roller coater, wire-bar coater, slot coater, doctor blade coater, gravure coater, powder coating and the like, and dried at from 40 to about 200° C. for from 10 minutes to several hours under stationary conditions or in an air flow. The coating is accomplished to provide a final coating thickness of from 0.01 to about 30.

Imaging members of the present invention are useful in various electrostatographic imaging and printing systems, particularly those conventionally known as xerographic processes. Specifically, the imaging members of the present invention are useful in xerographic imaging processes wherein photogenerating pigments may absorb light of a wavelength of from about 400 nanometers to about 900 nanometers. In these known processes, electrostatic latent images are initially formed on the imaging member followed by development, and thereafter transferring the image to a suitable substrate.

Moreover, the imaging members of the present invention can be selected for electronic printing processes with gallium arsenide light emitting diode (LED) arrays which typically function at wavelengths of from 660 to about 830 nanometers.

DESCRIPTION OF SPECIFIC EMBODIMENTS

A negatively charged photoresponsive imaging member of the present invention is comprised of a supporting substrate obtained with the processes of the present invention, a solution coated adhesive layer thereover comprised, for example, of a polyester 49,000 available from Goodyear Chemical, a photogenerator layer in contact with the adhesive layer and comprised of photogenerating pigments optionally dispersed in an inactive resinous binder, and a top charge transport layer comprised of N,N'-diphenyl-N,N'-bis(3-methyl phenyl)-1,1'-biphenyl-4,4'-diamine, dispersed in a polycarbonate resinous binder.

Rather than the known substrate layers, such as layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass or the like, there is selected the supporting substrate obtained with the processes of the present invention. The substrate may be flexible, seamless, or rigid and many have a number of many different configurations, such as for example a plate, a cylindrical drum, a scroll, an endless flexible belt, and the like.

The thickness of the substrate layer depends on many factors, including economical considerations, thus this layer may be of substantial thickness, for example, over 3,000 microns, or of minimum thickness providing there are no adverse effects on the system. In embodiments, the thickness of this layer is from about 75 microns to about 300 microns.

With further regard to the imaging members, the photogenerator layer is preferably comprised of x-metal free phthalocyanines or titanyl phthalocyanine pigments dispersed in resinous binders. Generally, the thickness of the photogenerator layer depends on a number of factors, including the thicknesses of the other layers and the amount of photogenerator material contained in this layer. Accordingly, this layer can be of a thickness of from about 0.05 micron to about 10 microns when the titanyl phthalocyanine photogenerator composition is present in an amount of from about 5 percent to about 100 percent by volume. In one embodiment, this layer is of a thickness of from about 0.25 micron to about 1 micron when the photogenerator composition is present in this layer in an amount of 30 to 75 percent by volume. The maximum thickness of this layer in an embodiment is dependent primarily upon factors, such as photosensitivity, electrical properties and mechanical considerations. The charge generator layer can be obtained by dispersion coating the TiOPc obtained with the processes of the present invention, and a binder resin with a suitable solvent. The binder may be omitted. The dispersion can be prepared by mixing and/or milling the photogenerating pigment in paint shakers, ball mills, sand mills and attritors. Common grinding media such as glass beads, steel balls or ceramic beads may be used in this equipment. The binder resin may be selected from the polymers obtained with the processes of the present invention, or from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. The solvents to dissolve these binders depend upon the particular resin. In embodiments of the present invention, it may be desirable to select solvents that do not effect the other coated layers of the device. Examples of solvents useful for coating the photogenerating pigment dispersions to form a photogenerator layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate and methoxyethyl acetate, and the like.

The coating of the photogenerating pigment dispersion in embodiments of the present invention can be accomplished with spray, dip or wire-bar methods such that the final dry thickness of the charge generator layer is from 0.01 to 30 microns and preferably from 0.1 to 15 microns after being dried at 40° to 150° C. for 5 to 90 minutes.

As adhesives usually in contact with the supporting substrate, there can be selected various known substances inclusive of polyesters, polyamides, poly(vinyl butyral), poly(vinyl alcohol), polyurethane and polyacrylonitrile. This layer is of a thickness of from about 0.05 micron to 1 micron. Optionally, this layer may contain conductive and nonconductive particles such as zinc oxide, titanium dioxide, silicon nitride, carbon black, and the like to provide, for example, in embodiments of the present invention desirable electrical and optical properties.

Aryl amines selected for the hole transporting layer which generally is of a thickness of from about 5 microns to about 75 microns, and preferably of a thickness of from about 10 microns to about 40 microns, include molecules of the following formula

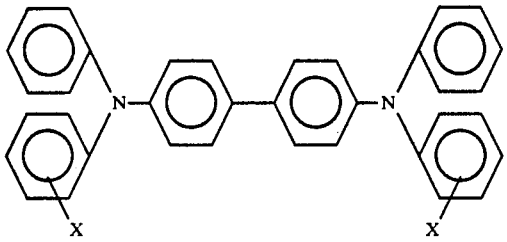

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)-1,1-biphenyl-4,4'-diamine wherein alkyl is selected from the group consisting of methyl, such as 2-methyl, 3-methyl and 4-methyl, ethyl, propyl, butyl, hexyl, and the like. With chloro substitution, the amine is N,N'-diphenyl-N,N'-bis(halo phenyl)-1,1'-biphenyl-4,4'-diamine wherein halo is 2-chloro, 3-chloro or 4-chloro. Other known charge transport layer molecules can be selected, reference for example U.S. Pat. Nos. 4,921,773 and 4,464,450, the disclosures of which are totally incorporated herein by reference.

Examples of the highly insulating and transparent resinous material or inactive binder resinous material for the transport layers include those described in U.S. Pat. No. 3,121,006, the disclosure of which is totally incorporated herein by reference. Specific examples of organic resinous materials in embodiments may include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the resinous binder contains from about 10 to about 75 percent by weight of the active charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

Embodiments of the present invention include a process for the preparation of supporting substrates which comprises heating a mixture of cyclic oligomers with degrees of polymerization of from about 2 to about 20 and a catalyst; a process for the preparation of supporting substrates for layered imaging members which comprises heating a mixture of cyclic oligomers with degrees of polymerization of from about 2 to about 20 and a catalyst to obtain a polycarbonate resin formed as web or drum, and wherein the cyclic oligomer mixture is represented by the formula

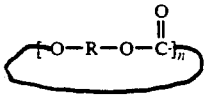

where n represents the degree of polymerization and is from 2 to about 20, R represents the principle repetition unit of the formula

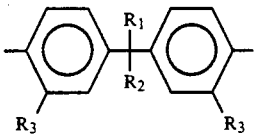

wherein $R_1$, $R_2$, and $R_3$ are independently selected from the group consisting of hydrogen, alkyl and aryl such as phenyl, benzyl, halogen, and halogen substituted alkyl wherein alkyl is, for example, methyl, ethyl, propyl, butyl, and the like, and aryl. Aryl includes aromatic components with, for example, from 6 to about 24 carbon atoms, such as phenyl, naphthyl, benzyl and the like.

The following Examples are provided.

EXAMPLE I

Synthesis of BP(A) Cyclic Oligomers

The reaction was conducted in a one liter Morton flask equipped with a mechanical stirrer, a condenser, septum, addition funnel and heating mantle. To this flask were added 200 milliliters of $CH_2Cl_2$, 7 milliliters of deionized water, 3 milliliters of 9.75 Molar NaOH solution, and 2.4 milliliters of triethyl amine. Stirring and gentle reflux were then initiated. Bisphenol A bischloroformate, about 70.5 grams, obtained from VanDeMark Chemical Company of Lockport, N.Y., previously recrystallized from hexane, was dissolved into 200 milliliters of methylene chloride and added to the above flask by means of a peristaltic pump over a period of 40 minutes. Concurrently, about 59 milliliters of about 9.75 Molar sodium hydroxide solution were added by means of the addition funnel and about 2.4 milliliters of triethyl amine added by means of a syringe pump. After 40 minutes, the reaction was terminated by the addition of 200 milliliters of 1 Molar HCl solution. The reaction mixture was transferred to a separatory funnel where the organic and aqueous layers separated and the organic layer was washed with deionized water (3 times) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 grams of a mixture of different ring sizes wherein the different sized rings are made up of different numbers of constituent members from 2 to 15 (different "n's") of cyclic oligomers of 4,4'-isopropylidenebisphenol carbonate substantially similar to the oligomers of Brunelle, *Macromolecules*, 1991, 24, 2035; typical distribution of 5 percent dimer, 18 percent rimer, 16 percent pentamer, 9 percent hexamer, and 25 percent large ring sizes. Confirmation of the product structure was determined by GPC and NMR. GPC analysis showed a cluster of about 6 discernible peaks with the weight average molecular weight for the entire group of about 1,200 Daltons relative to polystyrene. NMR analysis was consistent with a cyclic for the mixture 4,4'-isopropylidenebisphenol carbonate structure.

EXAMPLE II

About 0.85 gram of the cyclic oligomers obtained in Example I and 0.15 gram of acetylene carbon black were ground and mixed for about three minutes with an agate mortar and pestle. About 0.0035 gram of tetrabutylammonia tetraphenylborate was added to the mixture in the mortar and a further three minutes of grinding and mixing was accomplished. The resulting fine powder mixture was spread thinly about the bottom of a petrie dish and then heated in an inert atmosphere for about 20 minutes. The heating was accomplished with a hot plate set to about 300° C. Upon cooling, the resulting product was measured for conductivity with a volt meter and was found to have a resistance of about 300 ohms. A portion, about 10 milligrams, of the resulting film was dissolved in THF, filtered and its molecular weight measured by GPC. The GPC results indicate that about 60 percent of the cyclic oligomers had been converted to polymer poly(4,4'-isopropylidenebisphenol) carbonate with a high molecular weight, $M_w$ of 153,000 and $M_n$ of 90,400 relative to polystyrene standards.

EXAMPLE III

About 0.85 gram of the cyclic oligomers obtained in Example I and 0.15 grams of acetylene carbon black were ground and mixed for about three minutes with an agate mortar and pestle. About 0.0050 gram of tetrabutylammonia tetraphenylborate catalyst was added to the mixture in the mortar and a further three minutes of grinding and mixing was accomplished. The resulting fine powder mixture was spread thinly between two TEFLON® discs upon which a 2 killigrams weight was placed and then the mixture was heated in an inert atmosphere for about 20 minutes. The heating was accomplished with a hot plate set to about 285° C. A portion, about 10 milligrams, of the product was dissolved in THF, filtered and its molecular weight measured by GPC. The GPC results indicate that about 15 percent of the cyclic oligomers had been converted to high molecular weight polymer poly(4,4'-isopropylidenebisphenol) carbonate and the molecular weight of this polymer was found to be $M_w$ of 167,000 and $M_n$ of 88,100 relative to polystyrene standards.

The remaining sample, about 0.1 gram, was returned to the hot plate and heated at 300° C. for a further 60 minutes. A tough continuous film resulted with a resistance measured with a volt meter of about 1,000 ohms. A portion, about 10 milligrams, of the film was dissolved in THF, filtered and its molecular weight measured by GPC. The GPC results indicate that about 80 percent of the cyclic oligomers had been converted to high polymer poly(4,4'-isopropylidenebisphenol) carbonate and the molecular weight of this polymer was found to be $M_w$ of 105,000 and $M_n$ of 57,600 relative to polystyrene standards.

EXAMPLE IV

About 0.95 gram of the cyclic oligomers obtained in Example I and 0.05 gram of acetylene carbon black were ground and mixed for about three minutes with an agate mortar and pestle. About 0.0048 gram of tetrabutylammonia tetraphenylborate catalyst was added to the mixture in the mortar, and a further five minutes of grinding and mixing was accomplished. The resulting fine powder mixture was spread thinly less than a millimeter between two TEFLON® discs upon which a 2 killigrams weight was placed and then the powder was heated in an inert atmosphere for about twenty minutes. The heating was accomplished with a hot plate set to about 285° C. Upon cooling, the resulting product was measured for electrical resistance with a volt meter and was found to be about 2,000,000 ohms. A portion, about 10 milligrams, of the film was dissolved in THF, filtered and its molecular weight measured by GPC. The GPC results indicate that greater than about 95 percent of the cyclic oligomers had been converted to high polymer poly(4,4'-isopropylidenebisphenol) carbonate and the molecular weight of this polymer was found to be $M_w$ of 262,000 and $M_n$ of 98,500 relative to polystyrene standards.

EXAMPLE V

About 0.9 gram of the cyclic oligomers obtained in Example I and 0.1 gram of acetylene carbon black were ground and mixed for about three minutes with an agate mortar and pestle. About 0.0044 gram of tetrabutylammonia tetraphenylborate catalyst was added to the mixture in the mortar and a further five minutes of grinding and mixing carried out. The resulting fine powder mixture was spread thinly between two TEFLON® discs upon which a 2 killigrams weight was placed and then heated in an inert atmosphere for about 20 minutes. The heating was accomplished with a hot plate set to about 285° C. Upon cooling, the resulting product was measured for electrical resistance and was found to be about 5,000 ohms. A portion, about 10 milligrams, of the film was dissolved in THF, filtered and its molecular weight measured by GPC. The GPC results indicate that about 72 percent of the cyclic oligomers had been converted to high polymer and the molecular weight of this polymer was found to be $M_w$ of 245,000 and $M_n$ of 124,000 relative to polystyrene standards.

EXAMPLE VI

About 0.9 gram of the cyclic oligomers obtained in Example I and about 0.003 gram of aluminum di(isopropoxide)acetoacetic ester chelate are dissolved in methylene chloride to achieve thorough mixing and the solvent is allowed to evaporate, and the resulting solid ground with carbon black and heated as in Example II, resulting in a dispersion of carbon black in poly(4,4'-isopropylidenebisphenol) carbonate.

EXAMPLE VII

The process of Example VI could be repeated except that the catalyst employed is titanium diisopropoxide bis(2,4-pentanedione).

Other modifications of the present invention may occur to those skilled in the art subsequent to a review of the present application and these modifications, including equivalents thereof, are intended to be included within the scope of the present invention.

What is claimed is:

1. A process for the preparation of supporting substrates for layered imaging members consisting essentially of heating a mixture of cyclic oligomers with degrees of polymerization of from about 2 to about 20 and a catalyst to obtain a polycarbonate resin formed as web or drum, and wherein said cyclic oligomer mixture is represented by the formula

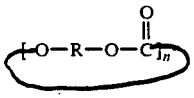

where n represents the degree of polymerization and is from 2 to about 20, and R represents the principle repetition unit of the formula

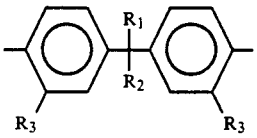

wherein $R_1$, $R_2$, and $R_3$ are independently selected from the group consisting of hydrogen, alkyl and aryl, halogen, and halogen substituted alkyl and aryl.

2. A process in accordance with claim 1 wherein the cyclic oligomer mixture contains linear oligomers as a minor component of no more than 15 percent to 20 percent by weight.

3. A process in accordance with claim 1 wherein two or more cyclic oligomer mixtures of different repeat unit structures are selected to obtain a copolycarbonate.

4. A process in accordance with claim 3 wherein the photogenerating layer is comprised of photogenerating pigments optionally dispersed in a resin binder.

5. A process in accordance with claim 1 wherein a crosslinking agent is added to the cyclic oligomer mixture.

6. A process in accordance with claim 1 wherein the imaging member contains in contact with the supporting substrate a photogenerating layer, and thereover a charge transport layer comprised of charge transport molecules comprised of aryl diamines.

7. A process in accordance with claim 6 wherein the charge transport molecules are comprised of aryl amines of the formula

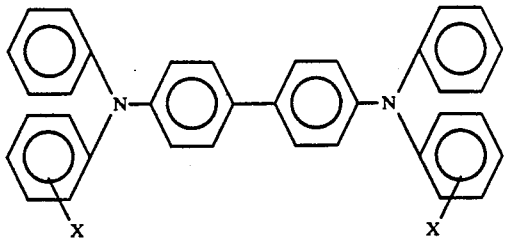

wherein X is selected from the group consisting of alkyl and halogen.

8. A process in accordance with claim 1 wherein the polycarbonate resin is poly(4,4'-hexafluoroisopropylidenebisphenol) carbonate; poly(4,4'-(1,4-phenylenebisisopropylidene)bisphenol) carbonate; poly(4,4'-(1,4-phenylenebisethylidene)bisphenol) carbonate; poly(4,4'-cyclohexylidenebisphenol) carbonate; poly(4,4'-isopropylidenebisphenol) carbonate; poly(4,4'-cyclohexylidene-2,2'-dimethylbisphenol) carbonate; poly(4,4'-isopropylidene-2,2'-dimethylbisphenol) carbonate; poly(4,4'-diphenylmethylidenebisphenol) carbonate; poly(4-t-butylcyclohexylidenebisphenol) carbonate; poly(4,4'-hexafluoroisopropylidenebisphenol-co-4,4'-(1,4-phenylenebisisopropylidene)bisphenol) carbonate; poly(4,4'-hexafluoroisopropylidenebisphenol-co-4,4'-isopropylidene-2,2'-dimethylbisphenol) carbonate; poly(4,4'-hexafluoroisopropylidenebisphenol-co-4,4'-isopropylidenebisphenol) carbonate; poly(4,4'-isopropylidene-2,2'-dimethylbisphenol-co-4,4'-isopropylidenebisphenol) carbonate; poly(4,4'-isopropylidene-2,2'-dimethylbisphenol-co-4,4'-(1-phenylethylidene)bisphenol) carbonate; or poly(4,4'-isopropylidene-2,2'-dimethylbisphenol-co-4,4'-cyclohexylidenebisphenol) carbonate.

9. A process in accordance with claim 1 further including in the formed substrate a filler component which filler is added to the mixture of cyclic oligomers prior to conversion to said polymer.

10. A process in accordance with claim 9 wherein the filler component is silica or glass fiber.

11. A process in accordance with claim 1 further including in the formed substrate conductive components in amounts of from about 10 to about 20 weight percent and capable of reducing the resistance of the substrate to about 2,000 ohms or less to provide a conductive ground plane for the application of charge to an imaging member containing said substrate.

12. A process in accordance with claim 11 wherein the conductive component is carbon black.

13. A process in accordance with claim 1 wherein the catalyst is selected from the group consisting of aluminum di(isopropoxide acetoacetic ester chelate, tetrabutylammonium tetraphenylborate, tetramethylammonium tetraphenylborate, titanium diisopropoxide bis(2,4-pentanedione), titanium tetraisopropoxide, titanium tetrabutoxide, tetraphenylphosphonium tetraphenylborate, lithium penoxide, and lithium salicylate.

14. A process for the preparation of supporting substrates for layered photoconductive imaging members, which imaging members are comprised of said supporting substrates, a photogenerating layer and a charge transport layer, the improvement residing in heating a mixture of cyclic oligomers with degrees of polymerization of from about 2 to about 20 in the presence of a catalyst to obtain a polycarbonate resin, and wherein the cyclic oligomer mixture is represented by the formula

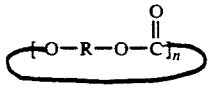

where n represents the degree of polymerization and is from 2 to about 20, and R represents the principle repetition unit of the formula

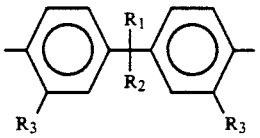

wherein $R_1$, $R_2$, and $R_3$ are independently selected from the group consisting of hydrogen, alkyl and aryl, halogen, and halogen substituted alkyl and aryl.

15. A process in accordance with claim 14 wherein the polycarbonate resin is poly(4,4'-hexafluoroisopropylidenebisphenol) carbonate; poly(4,4'-(1,4-phenylenebisisopropylidene)bisphenol) carbonate; poly(4,4'-(1,4-phenylenebisethylidene)bisphenol) carbonate; poly(4,4'-cyclohexylidenebisphenol) carbonate; poly(4,4'-isopropylidenebisphenol) carbonate; poly(4,4'-cyclohexylidene-2,2'-dimethylbisphenol) carbonate; poly(4,4'-isopropylidene-2,2'-dimethylbisphenol) carbonate; poly(4,4'-diphenylmethylidenebisphenol) carbonate; poly(4-t-butylcyclohexylidenebisphenol) carbonate; poly(4,4'-hexafluoroisopropylidenebisphenol-co-4,4'-(1,4-phenylenebisisopropylidene)bisphenol) carbonate; poly(4,4'-hexafluoroisopropylidenebisphenol-co-4,4'-isopropylidene-2,2'-dimethylbisphenol) carbonate; poly(4,4'-hexafluoroisopropylidenebisphenol-co-4,4'-isopropylidenebisphenol) carbonate; poly(4,4'-isopropylidene-2,2'-dimethylbisphenol-co-4,4'-isopropylidenebisphenol) carbonate; poly(4,4'-isopropylidene-2,2'-dimethylbisphenol-co-4,4'-(1-phenylethylidene)bisphenol) carbonate; or poly(4,4'-isopropylidene-2,2'-dimethylbisphenol-co-4,4'-cyclohexylidenebisphenol) carbonate.

16. A process in accordance with claim 15 wherein the polycarbonate has a molecular weight of from about 153,000 to about 262,000 weight average.

* * * * *